United States Patent [19]

Schwab et al.

[11] Patent Number: 4,526,586

[45] Date of Patent: Jul. 2, 1985

[54] MICROEMULSIONS FROM VEGETABLE OIL AND AQUEOUS ALCOHOL WITH 1-BUTANOL SURFACTANT AS ALTERNATIVE FUEL FOR DIESEL ENGINES

[75] Inventors: Arthur W. Schwab; Everett H. Pryde, both of Peoria, Ill.

[73] Assignee: The United States of America as represented by the Secretary of Agriculture, Washington, D.C.

[21] Appl. No.: 423,402

[22] Filed: Sep. 24, 1982

[51] Int. Cl.[3] ..... C10L 1/18

[52] U.S. Cl. ..... 44/53; 44/66; 44/57; 252/356; 252/357

[58] Field of Search ..... 44/53, 66, 57; 252/356, 252/357

[56] References Cited

U.S. PATENT DOCUMENTS

| | | | |
|---|---|---|---|
| 2,892,694 | 3/1960 | Weeks | 44/51 |
| 4,083,698 | 4/1978 | Wenzel et al. | 44/51 |
| 4,297,107 | 10/1981 | Boehmke | 44/51 |
| 4,300,912 | 11/1981 | Townsend | 44/56 |
| 4,359,324 | 11/1982 | Elsea, Jr. et al. | 44/53 |
| 4,397,655 | 8/1983 | Sweeney | 44/53 |

OTHER PUBLICATIONS

Hydrocarbon Processing, May 1979, pp. 127 to 138; "Alcohols as Motor Fuels?", J. Keller.

P. A. Boruff et al., "Engine Evaluation of Diesel Fuel-Aqueous Ethanol Microemulsions," ASAE Paper No. 80-1523, Dec. 2-5, 1980.

C. E. Goering, "Vegetable Oil as Diesel Fuel Progress Report," Vegetable Oil as Diesel Fuel Seminar II, NAEC/NRRC, Peoria, IL, Oct. 21-22, 1981.

A. W. Schwab et al., "Vegetable Oil Microemulsions as Diesel Fuel," Vegetable Oil as Diesel Fuel Seminar II, NAEC/NRRC, Peoria, IL, Oct. 21-22, 1981.

C. E. Goering et al., "Evaluation of Soybean Oil-Aqueous Ethanol Microemulsions for Diesel Engines," Proceedings of International Conference on Plant and Vegetable Oils as Fuel, Fargo, ND, Aug. 2-4, 1982.

*Primary Examiner*—William R. Dixon, Jr.
*Assistant Examiner*—Margaret B. Medley
*Attorney, Agent, or Firm*—M. Howard Silverstein; David G. McConnell; Curtis P. Ribando

[57] ABSTRACT

Hybrid fuel microemulsions are prepared from vegetable oil, a $C_1$-$C_3$ alcohol, water, and 1-butanol as the nonionic surfactant. These fuels are characterized by an acceptable viscosity and compare favorably to No. 2 diesel fuel in terms of engine performance properties.

6 Claims, 2 Drawing Figures

MICROEMULSIONS FROM VEGETABLE OIL AND AQUEOUS ALCOHOL WITH 1-BUTANOL SURFACTANT AS ALTERNATIVE FUEL FOR DIESEL ENGINES

CROSS-REFERENCE TO RELATED APPLICATION

This application is related to commonly assigned application Ser. No. 06/427,229, filed on Sept. 29, 1982, by Arthur W. Schwab and Everett H. Pryde entitled "Microemulsions from Vegetable Oil and Aqueous Alcohol with Trialkylamine Surfactant as Alternative Fuel for Diesel Engines,".

BACKGROUND OF THE INVENTION

1. Field of the Invention

The energy crisis of recent years has stimulated research in the field of alternate and hybrid fuels. One area of particular interest relates to fuels for commercial and agricultural vehicles, which are typically powered by diesel engines. The prospect of farmers becoming self-sufficient in regard to their energy needs has led to investigations of vegetable oils as diesel fuel substitutes. Deterrents to this concept are the generally inferior fuel properties of crude vegetable oils as compared to those of diesel oil. Of particular concern is the inherently high viscosity which causes poor atomization in direct-injected diesel engines. This results in fouling of the injectors and cylinders as well as a buildup of noncombusted fuel in the crankcase causing a thickening of the lubricating oil. This invention relates to a blended vegetable oil fuel which circumvents these problems.

2. Description of the Prior Art

One approach to the utilization of vegetable oil as fuel has been to mix it with conventional diesel oil. Insofar as these blends must contain at least two-thirds diesel fuel in order to have acceptable properties, they fall short of meeting the farmer's goal of energy self-sufficiency. Cracking and refining are effective in upgrading vegetable oils, but add considerably to the expense and also negate direct on-the-farm utilization of the harvested product. Likewise, transesterification with a lower alcohol yields a fuel with lower viscosity and acceptable performance properties, but reduces the feasibility of direct use. Moreover, the transesters have a solidification temperature of about 4° C., requiring the use of fuel preheaters in colder climates.

The concept of diluting the vegetable oil with ethanol, another energy source being investigated for on-the-farm generation, is confronted with the same difficulties characteristic of diesel fuel-ethanol hybrids. As pointed out by Wrage et al. [Technical Feasibility of Diesohol, ASAE Paper No. 79-1052 (1979)], the most critical problem is phase separation. Anhydrous ethanol and No. 2 diesel oil are miscible at room temperature, but trace amounts of water in the mixture will cause a phase separation and movement of the ethanol and water to the top of the container. The water tolerance of blends decreases with decreasing temperature. At 0° C., a water concentration of only 0.05% will cause phase separation. Since this amount can readily be absorbed in the fuel during transport and storage, anhydrous ethanol-oil blends tend to be impractical.

Accordingly, a preponderance of the research efforts on hybrid fuels has been aimed at increasing the water tolerance to not only allow for water absorption, but also to permit the use of aqueous alcohol. As opposed to anhydrous alcohol, the aqueous form having at least 5% water content is within the production capabilities of on-farm stills. Also, its recovery requires substantially less energy, and it is therefore less costly to produce. Moreover, it has been reported that when water is properly incorporated into a diesel fuel, it serves as a heat sink, thereby lowering combustion temperatures and reducing $NO_x$ and smoke emissions [G. Gillberg et al., Microemulsions as Diesel Fuels, pp. 221-231 in J. T. Zung (ed.), Evaporation-Combustion of Fuels. Advances in Chemistry Series No. 166, ACS]. This phenomenon is also discussed by N. R. Iammartino [Chem. Eng. 24: 84-88 (Nov. 11, 1974)], D. W. Brownawell et al., U.S. Pat. No. 3,527,581, and E. C. Wenzel et al., U.S. Pat. No. 4,083,698.

The intimate admixture of water and oil results in either a macroemulsion or a microemulsion. Macroemulsions have dispersed particles with diameters in the 200 to 10,000 nm. range and are not stable, eventually separating into two phases. Microemulsions are transparent, thermodynamically stable colloidal dispersions in which the diameter of the dispersed-phase particles is less than one-fourth the wavelength of visible light. Considerably more surfactant is required to create a microemulsion than a macroemulsion since the volume of the interphase of a microemulsion is an appreciable percentage of the total volume of the dispersed sphere (the core plus the interphase). Microemulsions of aqueous ethanol in vegetable oils are generally accepted as micellar systems and may be classified as detergent or detergentless.

In U.S. Pat. No. 4,083,698, Wenzel et al. prepares stable water-in-oil emulsions comprising (a) a hydrocarbon fuel, (b) water, (c) an alcohol, and (d) a multicomponent surfactant system comprising: (1) a long-chain fatty acid salt, or, more preferably, an ammonium or sodium long-chain fatty acid salt, or mixture thereof as the detergent; (2) a free unsaturated long-chain fatty acid, or a mixture of a free unsaturated organic acid and a free saturated long-chain fatty acid; and (3) a nonionic surfactant typified by ethylene oxide condensation products and esterification products of a fatty acid with ethylene oxide. Weeks (U.S. Pat. No. 2,892,694) prepares a water-emulsified motor fuel by means of a detergent-type emulsifier comprising the reaction product of alkyl-4-sulfophthalate and ammonia or an amine.

In the commonly assigned application Ser. No. 06/256,206, A. W. Schwab discloses stabilizing a diesel fuel microemulsion having relatively high levels of water and alcohol by means of a two-component surfactant system. One of the components is N,N-dimethylethanolamine which functions as the detergent, and the other is a long-chain fatty acid substance. Increasing levels of surfactant as necessitated by the higher levels of ethanol and water has the effect of increasing the fuel's viscosity.

SUMMARY OF THE INVENTION

We have now developed a vegetable oil-based hybrid fuel for diesel engines characterized by an acceptable viscosity. The fuel is a detergentless microemulsion in which water and alcohol are dispersed in the oil by means of 1-butanol serving as a single-component nonionic surfactant. Despite the absence of an ionic emulsifier, these microemulsions display all the desirable physical and chemical properties exhibited by those formulated with multicomponent detergent systems.

In accordance with this discovery, it is an object of the invention to convert crude vegetable oil into a fuel suitable for diesel engines without alteration of its chemical structure.

It is also an object of the invention to provide a simple formulation for a vegetable oil-based fuel which lends itself to on-the-farm blending.

Another object of the invention is to prepare a nonpetroleum alternative diesel fuel which is formulated from aqueous alcohol.

A further object of the invention is to produce a totally nonionic microemulsion fuel free of corrosive emulsifiers.

Other objects and advantages of the invention will become readily apparent from the ensuing description.

DETAILED DESCRIPTION OF THE INVENTION

Figure 1:
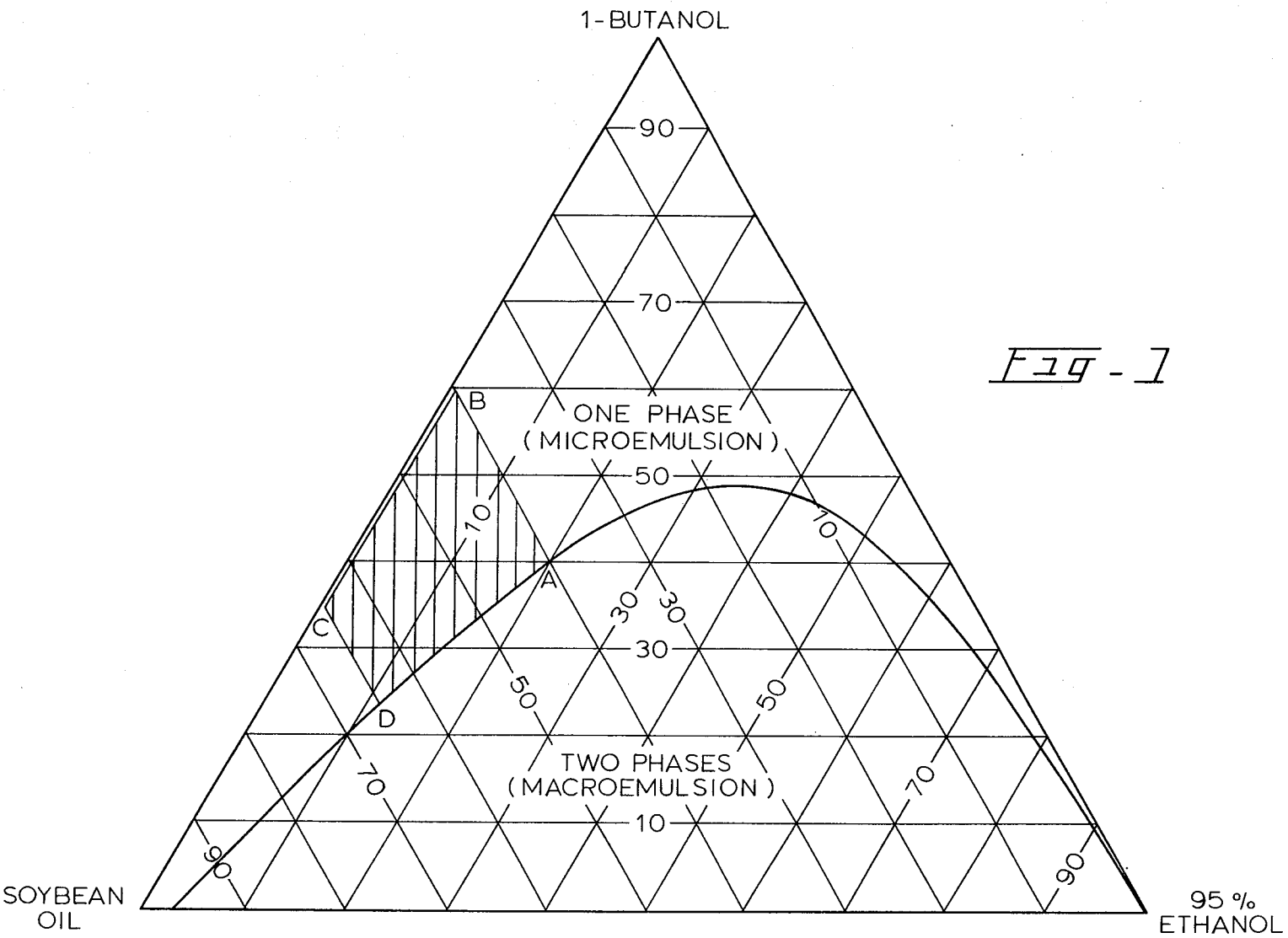
FIG. 1 is a three-component phase diagram at 25° C. illustrating the region of operability contemplated by the invention.

The base vegetable oils for use in the nonionic fuels of the invention are the commonly available vegetable triglycerides in which the preponderance of the fatty acid ester moieties have a chain length of 18 or more carbon atoms. The general suitability of these oils as diesel fuel substitutes has been summarized by C. E. Goering et al. (Fuel Properties of Eleven Vegetable Oils, Paper No. 81-3579, presented at the 1981 Winter Meeting of the American Society of Agricultural Engineers, Dec. 15–18, 1981). In terms of high cetane rating, long induction period, low viscosity, low cloud point, and low pour point, the preferred oils are soybean, corn, rapeseed, sesame, and cottonseed. However, others including crambe, sunflower, peanut, linseed, safflower, and high oleic safflower are also considered to be within the scope of the invention. While it is contemplated that these oils be employed in the crude state as originally expressed from the seed material, there are advantages to subjecting them to certain preliminary processing steps. For example, winterization to remove the saturated fatty acid triglycerides extends the lower end of the operable temperature range. Alkali refining removes the free fatty acids thereby enhancing the oxidative stability. Degumming is desirable for reduced tendency to deposit gummy residues, enhanced atomization, and inhibition of injector fouling. Viscosities of the aforementioned oils when degummed and alkali-refined typically range from about 27 centistokes (cSt., $mm.^2/s.$) at 37.8° C. for linseed oil to about 54 cSt. at 37.8° C. for crambe oil. Other properties related to the performance of these oils as engine fuels have been summarized by Goering, supra.

The alcohols contemplated for hybridizing with the diesel fuel are the lower water-miscible alcohols having from 1 to 3 carbon atoms. Preferred is ethanol for reasons of its combustion properties and availability. Of course, the advantages of the invention are best realized by employing the alcohol in aqueous form. Particularly preferred are aqueous ethanol solutions in which the water content ranges from 5–20%, corresponding to an ethyl alcohol:water volumetric ratio in the range of 19:1 to 4:1, respectively.

The surfactant consisting essentially of 1-butanol uniquely converts the mixture of vegetable oil and aqueous alcohol to a microemulsion without the need for an ionic detergent. The relative proportions of these components, as well as the particular selection of vegetable oil and alcohol, will determine the properties of the final fuel composition. In formulating the hybrid fuels of the invention, primary consideration is given to microemulsion stability and viscosity. Acceptable viscosities would typically be in the range of about 2–9 cSt. at 37.8° C. Other pertinent properties relate to engine performance, including cetane number, power output, brake thermal efficiency, and the like.

In regard to the proportion of the oil in the hybrid fuel formulations, the upper limit will be set by the maximum tolerable viscosity (about 9 cST. at 37.8° C.), and the lower limit by engine performance as determined by a person of ordinary skill in the art. For most of the aforementioned vegetable oils the level of addition will be within the range of about 40–65% by volume. The remainder of the composition comprises the aqueous alcohol and the 1-butanol surfactant in any combination yielding a microemulsion which is stable at or above a predetermined temperature and which is characterized by an acceptable viscosity. In order for the microemulsified water to have a noticeable impact on the fuel's combustion properties, it should be incorporated in an amount of at least about 0.1%. This level can be achieved for example by the addition of 2% of 95% aqueous alcohol or 0.5% of 80% aqueous alcohol. Within the confines of these parameters, the properties of the hybrid fuels can be tailored to satisfy a multitude of conditions. For example, as the proportion of vegetable oil to water and/or lower alcohol is increased, the cetane number increases. As the relative amount of water to lower alcohol decreases, particularly at the higher ratios of vegetable oil to alcohol, or as the butanol level increases, the viscosity decreases. Also, reduction of the water:alcohol ratio enhances the tolerance of the system to phase separation, thereby either permitting the use of less surfactant, or allowing the ratio of alcohol to vegetable oil to be increased. The component primarily responsible for offsetting the viscosity of the oil is the aqueous alcohol, and it is therefore preferable to maximize its content by selecting formulations close to the miscibility curve, particularly at the higher levels of oil.

The ternary diagram of FIG. 1 illustrates fuels within the scope of the invention wherein the aqueous alcohol is 95% ethanol. At 25° C., the formulations above the miscibility curve will exist as one visible phase in the form of thermodynamically stable microemulsions, while those below the curves will be unstable and have two visible immiscible phases. The area above the curve varies directly with both the ethanol:water ratio and the specified temperature level. That is, as either the relative amount of water increases, or the specified temperature decreases, the area above the curve decreases. Fuels formulated within the aforementioned parameters must of course come within the microemulsion region of the appropriate diagram for a predetermined temperature specification. The miscibility curve depicted in FIG. 1 is based upon hybrid fuels formulated from soybean oil. It is understood that the curves for the other aforementioned vegetable oils would be of the same general shape but not necessarily coincident with that shown. The shaded area ABCD represents the approximate domain of formulations within the scope of the invention. Formulations represented by the upper portion of this area will have critical solution temperatures approximating 0° C.

The order of adding the fuel constituents to one another is not particularly critical. Though the microemulsions will form spontaneously without mixing, any conventional means of simple agitation such as gentle stirring or shaking will expedite the process.

The actual physical structure of a detergentless microemulsion is unknown. However, in the context of the present system, it can be thought of as the presence of an interphase separating microscopic water droplets in the discontinuous phase from the vegetable oil in the continuous phase. The presence of a microemulsion is readily ascertained by standard methods of rheology, ultracentrifugation, conductivity, refractivity, and density.

The hybrid fuels of this invention tend to have cetane numbers lower than the minimum ASTM specification of 40 for No. 2 diesel oil, but nevertheless perform remarkably well in engine tests. This is presumably attributable to the presence of the water. However, it is envisioned that cetane improvers such as primary alkyl nitrates and other fuel additives as known in the art may be included in the instant formulations in minor amounts without significant adverse effect on the microemulsion stability. Primary alkyl nitrates actually enhance the stability.

The following examples are intended only to further illustrate the invention and are not intended to limit the scope of the invention which is defined by the claims.

EXAMPLE 1

Into a sample vial were pipetted the following components:

| Component | Parts by volume |
|---|---|
| soybean oil | 53.3 |
| 95% ethanol | 13.3 |
| 1-butanol | 33.4 |

Upon gently shaking the sample vial at approximately 25° C., the mixture immediately formed a clear, homogeneous microemulsion characterized by the properties set forth in Table I, below.

EXAMPLE 2

A nonionic hybrid microemulsion fuel formulated in accordance with Example 1 was tested in a "John Deere Model 152" power unit. The three-cylinder, naturally aspirated direct-injection diesel engine displaced 2.491 liters and was rated at 26.3 kW at a speed of 2400 rev./min. The engine used a "Roosa Master" distributor-type injection pump with normal injection advanced 26° before head dead center.

The engine was connected through an overcentering clutch to a "Midwest Dynamic Type-768" eddy current dynamometer.

TABLE I

| Property | ASTM Method | Fuel: Hybrid | Fuel: Limits for No. 2 diesel |
|---|---|---|---|
| flash point, °C. | D 93 | 27.8 | 51.7 min. |
| pour point, °C. | D 97 | −65 | not specified |

TABLE I-continued

| Property | ASTM Method | Fuel: Hybrid | Fuel: Limits for No. 2 diesel |
|---|---|---|---|
| carbon residue, % | D 524 | 0.18 | 0.35 max. |
| viscosity at 37.8° C., cSt. | D 445 | 6.76 | 1.9–4.1 |
| cetane No. | D 613 | 25.1 | 40 min. |
| gross heat of combustion, kJ/kg. | std. bomb calorimeter | 37045[a] | 45343[b] |
| stoichiometric air-to-fuel ratio | — | 11.57[c] | 14.55[c] |

[a]Calculated from component values.
[b]Measured directly.
[c]Calculated.

Fuel consumption and engine speed were measured through use of an automatic weighing system and a standard chronotachometer that measured elapsed time and engine revolutions while 100 g. of fuel were being burned. Chromel-alumel thermocouples and an "Omega Model 199" digital indicator were used to monitor exhaust and coolant temperatures. A counterflow heat exchanger with automatic control of secondary water was used to regulate the temperature of the engine coolant. Air was supplied to the engine through an orifice meter connected to a double surge tank. A calibrated, inclined manometer permitted measurement of the pressure drop across the orifice. The double surge tank included a boost fan to maintain atmospheric pressure at the inlet of the engine.

The engine was started and run on No. 2 diesel fuel until the coolant reached the controlled temperature of 89±3° C. A baseline test was then run on No. 2 diesel fuel. Loading began at 2527 rev./min. high idle speed and increased until governor's maximum speed was reached. At each load, the load, speed, fuel, and air consumption and exhaust and coolant temperatures were measured.

After completion of the baseline run, the engine was switched to the nonionic hybrid fuel, the fuel return line was diverted to a waste container, and the engine was run until the diesel fuel was flushed from the system. The same test procedure used in the baseline tests was then repeated for the nonionic hybrid fuel. Finally, a second baseline test was run on No. 2 diesel fuel.

Although the nonionic hybrid contained 19% less energy per kilogram than No. 2 diesel fuel (Table I), it produced almost the same peak power (Table II). As indicated by the equivalence ratio (actual fuel-air ratio divided by the stoichiometric fuel-air ratio) in FIG. 2, the oxygen in the hybrid fuel caused it to burn cleaner than diesel fuel. This resulted in better thermal efficiencies, including a 6% gain at maximum power (Table II). Brake specific fuel consumption was somewhat higher (FIG. 2) with the hybrid than with the diesel fuel. Diesel knock was comparable for the two fuels, and thus the lower cetane number for the microemulsion was not reflective in engine performance.

TABLE II

| Test fuel | Max. power, kW | Fuel supplied, mg./injection | Energy supplied, kJ/injection | Brake thermal efficiency, % |
|---|---|---|---|---|
| No. 2 diesel (initial) | 24.1 | 86.1 | 3.91 | 30.5 |
| nonionic hybrid | 23.7 | 99.9 | 3.70 | 32.3 |
| No. 2 diesel | 23.9 | 86.9 | 3.94 | 30.3 |

TABLE II-continued

| Test fuel | Max. power, kW | Fuel supplied, mg./injection | Energy supplied, kJ/injection | Brake thermal efficiency, % |
|---|---|---|---|---|
| (final) | | | | |

Figure 2:
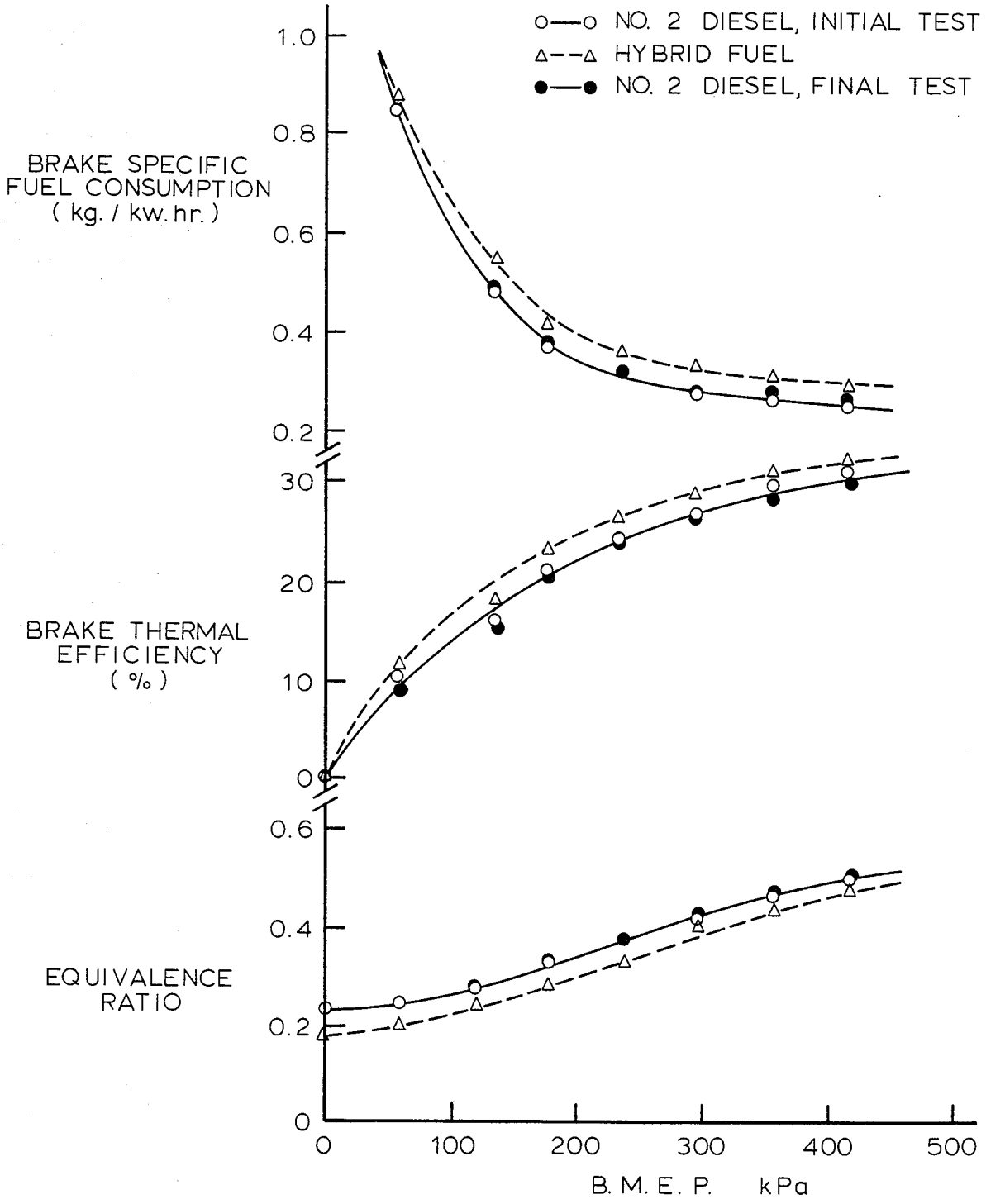
FIG. 2 is a series of engine performance curves comparing a hybrid microemulsion prepared in accordance with the invention to No. 2 diesel fuel on the basis of three fuel properties.

All of the data in FIG. 2 were taken at an air temperature of 20±2° C. and are plotted against brake mean effective pressure (BMEP), or specific torque. For the test engine, the torque in Newton meters would be 0.198 times the BMEP.

EXAMPLE 3

A nonionic hybrid fuel formulated in accordance with that of Example 1 was supplemented with primary alkyl nitrate (P.A.N.) ($C_8H_{17}N_1O_3$) at levels of 5% and 10% by volume of the total mixture. The effect on the cetane number as measured by ASTM D 613 method is reported below in Table III.

TABLE III

| P.A.N. % by volume | Cetane No. of fuel |
|---|---|
| 0 | 25.1 |
| 5 | 34 |
| 10 | 40 |

EXAMPLE 4

Nonionic hybrid fuel microemulsions were formulated by pipetting various proportions of soybean oil, 95% aqueous ethanol, and 1-butanol into sample vials and gently shaking. Kinematic viscosities were determined as reported below in Table IV.

EXAMPLE 5

The procedure of Example 4 was repeated except that 80% aqueous ethanol was substituted for the 95% ethanol. The results are reported below in Table V.

EXAMPLE 6

The procedure of Example 4 was repeated except that safflower oil was substituted for the soybean oil. The results are reported in Table VI, below.

EXAMPLE 7

The procedure of Example 4 was repeated except that sesame oil was substituted for the soybean oil. The results are reported in Table VII, below.

TABLE IV

| Formulation | Soybean oil (volume %) | 95% Ethanol (volume %) | 1-Butanol (volume %) | Viscosity at 37.8° C. (cSt.) |
|---|---|---|---|---|
| 4A | 59.3 | 14.8 | 25.9 | 8.27 |
| 4B | 57.1 | 14.3 | 28.6 | 7.89 |
| 4C | 53.3 | 13.3 | 33.4 | 6.76 |
| 4D | 50.0 | 12.5 | 37.5 | 6.39 |
| 4E | 47.0 | 11.8 | 41.2 | 5.87 |

TABLE V

| Formulation | Soybean oil (volume % | 80% Ethanol (volume %) | 1-Butanol (volume %) | Viscosity at 37.8° C. (cSt.) |
|---|---|---|---|---|
| 5A | 45.7 | 11.4 | 42.9 | 6.15 |

TABLE V-continued

| Formulation | Soybean oil (volume % | 80% Ethanol (volume %) | 1-Butanol (volume %) | Viscosity at 37.8° C. (cSt.) |
|---|---|---|---|---|
| 5B | 44.4 | 11.2 | 44.4 | 5.92 |
| 5C | 42.1 | 10.5 | 47.4 | 5.64 |
| 5D | 40.0 | 10.0 | 50.0 | 5.30 |

TABLE VI

| Formulation | Safflower oil (volume %) | 95% Ethanol (volume %) | 1-Butanol (volume %) | Viscosity at 37.8° C. (cSt.) |
|---|---|---|---|---|
| 6A | 63.2 | 15.8 | 21.0 | 8.34 |
| 6B | 57.1 | 14.3 | 28.6 | 7.23 |
| 6C | 52.2 | 13.0 | 34.8 | 6.50 |
| 6D | 48.0 | 12.0 | 40.0 | 6.07 |
| 6E | 41.4 | 10.3 | 48.3 | 5.16 |

TABLE VII

| Formulation | Sesame oil (volume %) | 95% Ethanol (volume %) | 1-Butanol (volume %) | Viscosity at 37.8° C. (cSt.) |
|---|---|---|---|---|
| 7A | 47.4 | 21.0 | 31.6 | 5.70 |
| 7B | 45.0 | 20.0 | 35.0 | 5.35 |
| 7C | 40.9 | 18.2 | 40.2 | 4.94 |

EXAMPLE 8

Nonionic microemulsions were prepared from a variety of vegetable oils formulated at 53.33% oil, 33.33% 1-butanol, and 13.33% 95% ethanol. Kinematic viscosities were determined as reported below in Table VIII.

It is understood that the foregoing detailed description is given merely by way of illustration and that modification and variations may be made therein without departing from the spirit and scope of the invention.

TABLE VIII

| Formulation | Vegetable oil | Viscosity at 37.8° C. (cSt.) Raw oil | Microemulsion |
|---|---|---|---|
| 8A | sunflower | 33.1 | 6.98 |
| 8B | soybean | 34.6 | 6.85 |
| 8C | sesame | 38.7 | 7.18 |
| 8D | safflower | 52.2 | 8.26 |
| 8E | rapeseed | 52.3 | 8.88 |

We claim:

1. A nonionic hybrid fuel composition comprising:

(a) from about 40–65% by volume vegetable oil composed of vegetable triglycerides in which the preponderance of the fatty acid ester moieties have a chain length of 18 or more carbon atoms;

(b) a lower ($C_1$14 $C_3$) alcohol;

(c) water, in an amount of at least about 0.1% by volume; and (d) 1-butanol wherein the ratio of the lower ($C_1$–$C_3$) alcohol:water is at least 4:1 and wherein said butanol is present in the fuel composition in an amount effective for said composition to exist as a thermodynamically stable microemulsion and the combined amount of lower alcohol, water, and 1-butanol relative to said vegetable oil is 35–60% by volume and is sufficient to impart to said composition a kinematic viscosity in the range of 2–9 centistokes at 37.8° C.

2. A hybrid fuel composition as described in claim 1 wherein said vegetable oil is selected from the group consisting of soybean, corn, rapeseed, sesame, cottonseed, crambe, sunflower seed, peanut, linseed, safflower, and high oleic safflower.

3. A hybrid fuel composition as described in claim 1 wherein said vegetable oil is soybean oil.

4. A hybrid fuel composition as described in claim 1 wherein said vegetable oil is sunflower seed oil.

5. A hybrid fuel composition as described in claim 1 wherein said lower alcohol is ethanol.

6. A hybrid fuel composition as described in claim 5 wherein the ratio of ethanol:water is about 19:1.

* * * * *